US010864735B2

(12) United States Patent
Kakamu et al.

(10) Patent No.: US 10,864,735 B2
(45) Date of Patent: Dec. 15, 2020

(54) LIQUID EJECTION HEAD

(71) Applicant: BROTHER KOGYO KABUSHIKI KAISHA, Nagoya (JP)

(72) Inventors: Katsumi Kakamu, Kuwana (JP); Masaaki Deguchi, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/529,915

(22) Filed: Aug. 2, 2019

(65) Prior Publication Data

US 2020/0039226 A1 Feb. 6, 2020

(30) Foreign Application Priority Data

Aug. 6, 2018 (JP) ..... 2018-147775

(51) Int. Cl.

| | |
|---|---|
| ***B41J 2/16*** | (2006.01) |
| ***B05B 11/04*** | (2006.01) |
| ***B41J 2/055*** | (2006.01) |
| *B41J 2/14* | (2006.01) |

(52) U.S. Cl.

CPC ..... *B41J 2/161* (2013.01); *B05B 11/04* (2013.01); *B41J 2/055* (2013.01); *B41J 2002/14241* (2013.01); *B41J 2002/14491* (2013.01)

(58) Field of Classification Search

CPC ..... B41J 2/16532; B41J 2/161; B41J 2/055; B41J 2002/14241; B41J 2002/14491; B41J 2/04501; B41J 2/14; B41J 2/2017; B05B 11/04; B41M 5/0047

See application file for complete search history.

(56) References Cited

U.S. PATENT DOCUMENTS

| | | | | |
|---|---|---|---|---|
| 7,901,063 | B2 * | 3/2011 | Wouters | B41J 2/17556 347/89 |
| 8,523,336 | B2 * | 9/2013 | Kuribayashi | B41J 2/17596 347/85 |
| 2016/0297193 | A1 | 10/2016 | Yoshida | |
| 2017/0151792 | A1 | 6/2017 | Kobayashi et al. | |

FOREIGN PATENT DOCUMENTS

| | | | |
|---|---|---|---|
| JP | 2016-030367 | A | 3/2016 |
| JP | 2016-199033 | A | 12/2016 |
| JP | 2017-113932 | A | 6/2017 |
| WO | WO 2015/199181 | A | 4/2017 |

* cited by examiner

*Primary Examiner* — Thinh H Nguyen

(74) *Attorney, Agent, or Firm* — Scully, Scott, Murphy & Presser, PC

(57) ABSTRACT

A liquid ejection head includes: individual passages; supply liquid passages; return liquid passages; a supply coupling liquid passage; and a return coupling liquid passage. The supply liquid passages and the return liquid passages extend in an extending direction and are arranged in an arrangement direction. The supply coupling liquid passage and the return coupling liquid passage extend in the arrangement direction, are located on one side of the supply liquid passages and the return liquid passages in the extending direction, and include an overlapping portion at which the supply coupling liquid passage and the return coupling liquid passage overlap each other when viewed in an orthogonal direction. A damper film is provided between the supply coupling liquid passage and the return coupling liquid passage in the orthogonal direction at at least a portion of the overlapping portion.

14 Claims, 7 Drawing Sheets

LIQUID EJECTION HEAD

CROSS REFERENCE TO RELATED APPLICATION

The present application claims priority from Japanese Patent Application No. 2018-147775, which was filed on Aug. 6, 2018, the disclosure of which is herein incorporated by reference in its entirety.

BACKGROUND

The following disclosure relates to a liquid ejection head including a plurality of individual passages each having a nozzle.

There is known a liquid ejection head including: a plurality of second common liquid passages (supply liquid passages) each communicating with inlets of corresponding ones of a plurality of individual passages; and a plurality of first common liquid passages (return liquid passages) each communicating with outlets of corresponding ones of the plurality of individual passages. The first common liquid passages are joined together by a first joining liquid passage (a return coupling liquid passage), and the second common liquid passages are joined together by a second joining liquid passage (a supply coupling liquid passage). Liquid is supplied from the second joining liquid passage to the second common liquid passages through their respective one ends. While flowing from the one end to the other end of each of the second common liquid passages, the liquid enters into the inlets of the respective individual passages communicating with the second common liquid passage. The liquid having flowed into each of the individual passages is partly ejected from a nozzle. The remaining portion of the liquid flows into a corresponding one of the first common liquid passages via the outlet of the individual passage. The liquid having flowed into the first common liquid passage flows from one end toward the other end of the first common liquid passage and is collected by the first joining liquid passage through the other end thereof.

SUMMARY

In the above-described liquid ejection head, the first joining liquid passage (the return coupling liquid passage) and the second joining liquid passage (the supply coupling liquid passage) are located respectively on one side and the other side of the first common liquid passages (the return liquid passages) and the second common liquid passages (the supply liquid passages) in an extending direction in which each of the common liquid passages extends. This increases the size of a region required for arrangement of the liquid passages in the extending direction, which may lead to increase in size of the liquid ejection head.

In the above-described liquid ejection head, it is considered to provide damper films for the first joining liquid passage (the return coupling liquid passage) and the second joining liquid passage (the supply coupling liquid passage) in order to reduce fluid crosstalk between the individual passages. However, if a damper film and a space for deformation of the damper film are formed for each of the first joining liquid passage and the second joining liquid passage, the number of components increases, which may lead to increase in manufacturing cost.

Accordingly, an aspect of the disclosure relates to a liquid ejection head with a reduced size in an extending direction and reduced manufacturing cost required for providing a damper film.

In one aspect of the disclosure, a liquid ejection head includes: a plurality of individual passages each having a nozzle; a plurality of supply liquid passages each communicating with an inlet of a corresponding one of the plurality of individual passages; a plurality of return liquid passages each communicating with an outlet of a corresponding one of the plurality of individual passages; a supply coupling liquid passage coupling the plurality of supply liquid passages to each other and communicating with an inlet of each of the plurality of supply liquid passages; and a return coupling liquid passage coupling the plurality of return liquid passages to each other and communicating with an outlet of each of the plurality of return liquid passages. The plurality of supply liquid passages and the plurality of return liquid passages extend in an extending direction and are arranged in an arrangement direction intersecting the extending direction. The supply coupling liquid passage and the return coupling liquid passage extend in the arrangement direction, are located on one side of the plurality of supply liquid passages and the plurality of return liquid passages in the extending direction, and include an overlapping portion at which the supply coupling liquid passage and the return coupling liquid passage at least partly overlap each other when viewed in an orthogonal direction orthogonal to each of the extending direction and the arrangement direction. A damper film is provided between the supply coupling liquid passage and the return coupling liquid passage in the orthogonal direction at at least a portion of the overlapping portion.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIG. 3 is a cross-sectional view of the head 1, taken along line in

FIG. 2;

FIG. 4 is a cross-sectional view of the head 1, taken along line IV-IV in

FIG. 2;

EMBODIMENTS

First Embodiment

Figure 1:
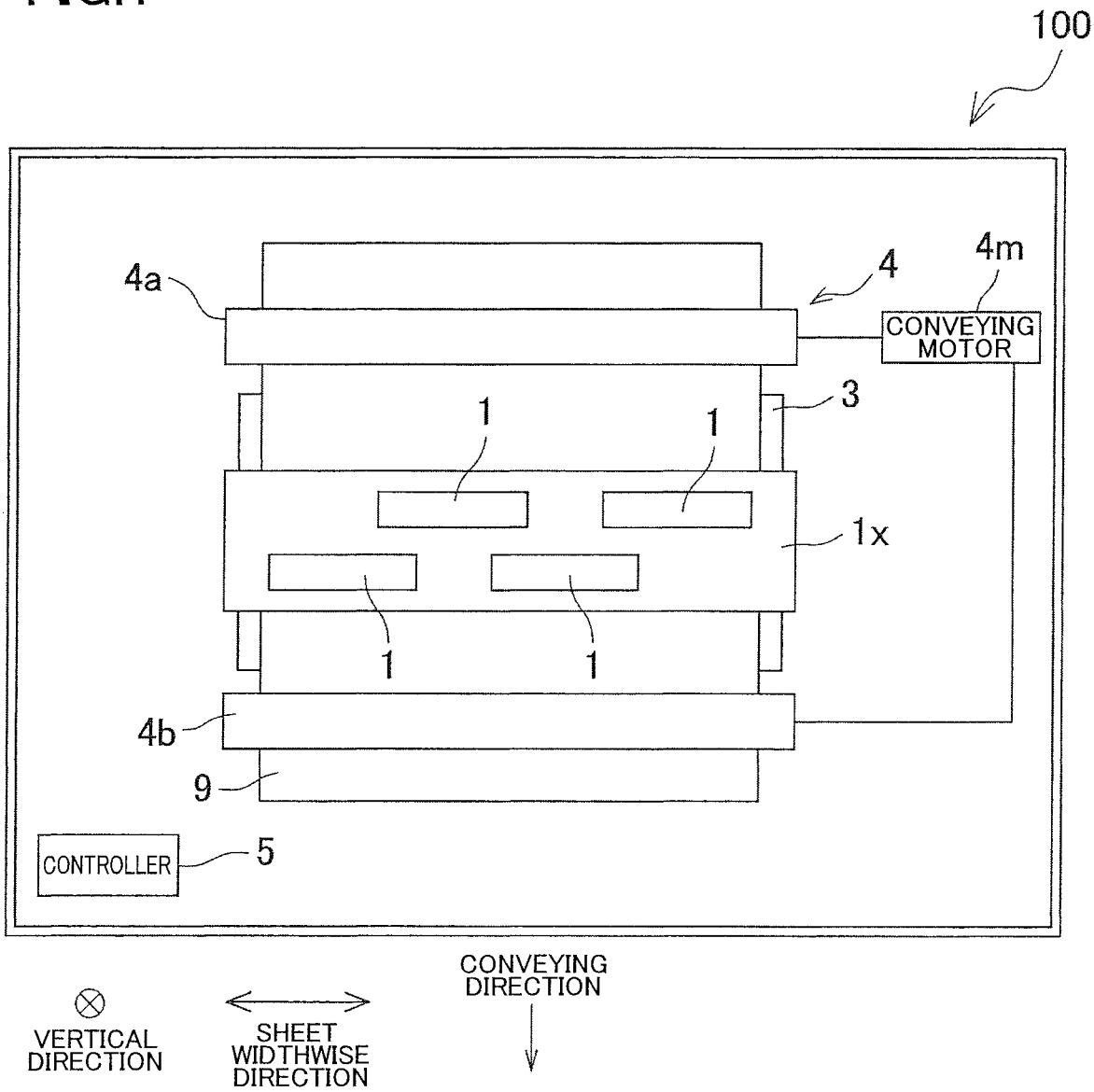
FIG. 1 is a plan view of a printer 100 including heads 1 according to a first embodiment.

Hereinafter, there will be described embodiments by reference to the drawings. First, there will be described, with reference to FIG. 1, an overall configuration of a printer 100 including heads 1 according to a first embodiment.

The printer 100 includes a head unit 1*x*, a platen 3, a conveying mechanism 4, and a controller 5. The head unit 1*x* includes the four heads 1.

An upper surface of the platen 3 is capable of supporting a sheet 9.

The conveying mechanism 4 includes two roller pairs 4*a*, 4*b*. The platen 3 is interposed between the roller pairs 4*a*, 4*b* in a conveying direction. When a conveying motor 4*m* is driven by the controller 5, the roller pairs 4*a*, 4*b* are rotated in a state in which the sheet 9 is nipped by the roller pairs 4*a*, 4*b*, whereby the sheet 9 is conveyed in the conveying direction.

The head unit 1*x* is of a line type and elongated in a widthwise direction of the sheet 9. The line type is a type in which the head unit 1*x* ejects ink onto the sheet 9 from nozzles 21 (see FIGS. 2 and 3), with the position of the head unit 1*x* being fixed. The four heads 1 are arranged in the widthwise direction of the sheet 9 in a staggered configuration.

Figure 6:
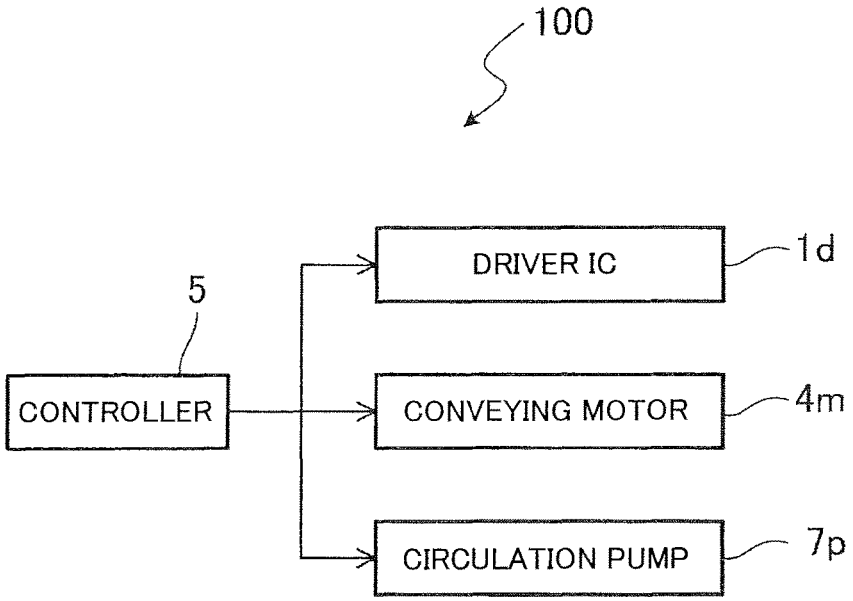
FIG. 6 is a block diagram illustrating an electric configuration of the printer 100.

The controller 5 includes a read-only memory (ROM), a random-access memory (RAM), and an application-specific integrated circuit (ASIC). The ASIC executes various processings, such as a recording processing, according to programs stored in the ROM. In the recording processing, the controller 5 controls the conveying motor 4*m* and a driver IC 1*d* of the head 1 (see FIGS. 3 and 6) to record an image on the sheet 9, based on a recording command (containing image data) input from an external device such as a personal computer (PC).

There will be next described a configuration of each of the heads 1 with reference to FIGS. 2-5. Since the heads 1 have the same configuration, the configuration of one of the heads 1 will be described for simplicity.

The head 1 includes a liquid-passage defining plate 11 and an actuator unit 12.

Figure 3:
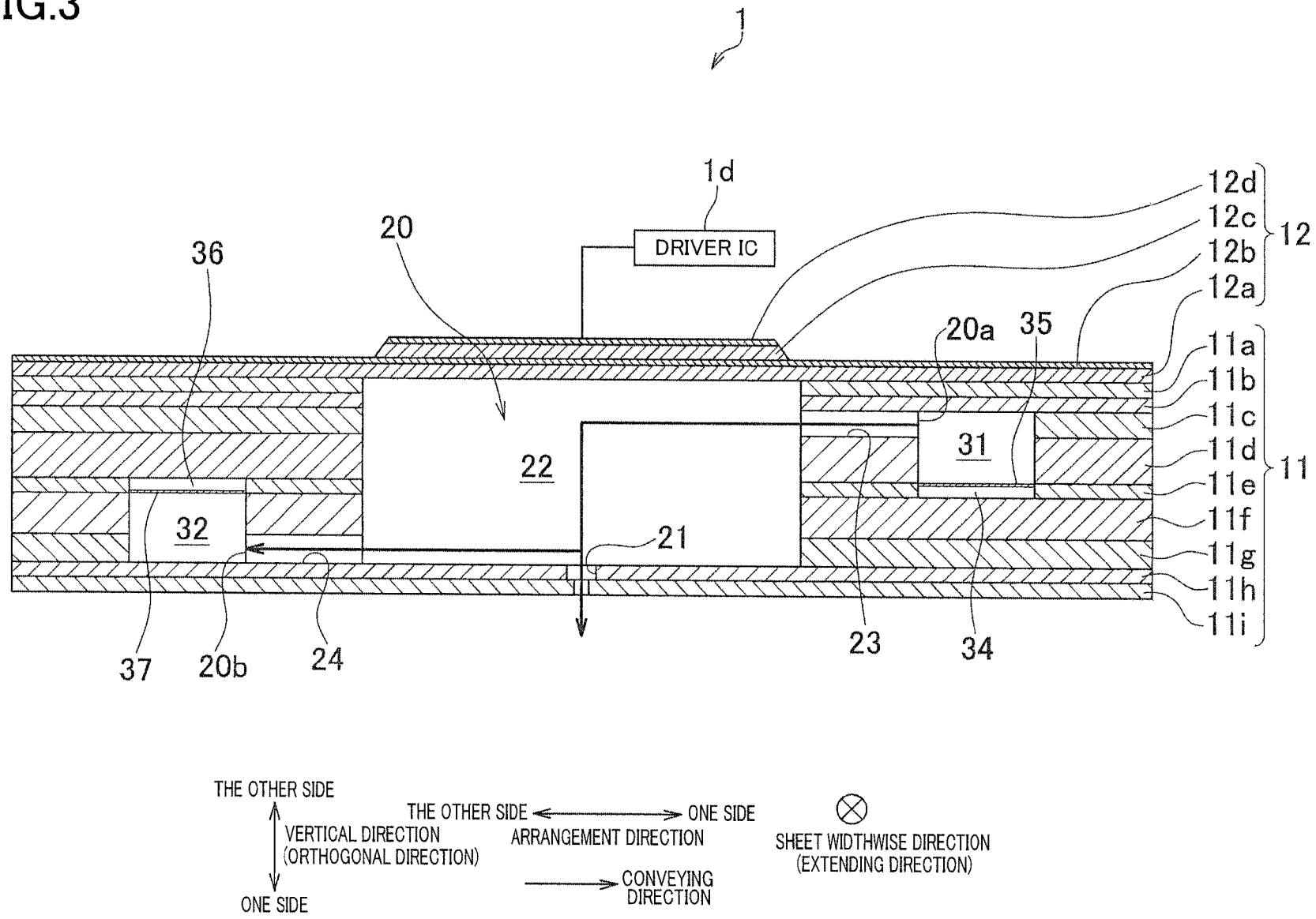
Figure 4:
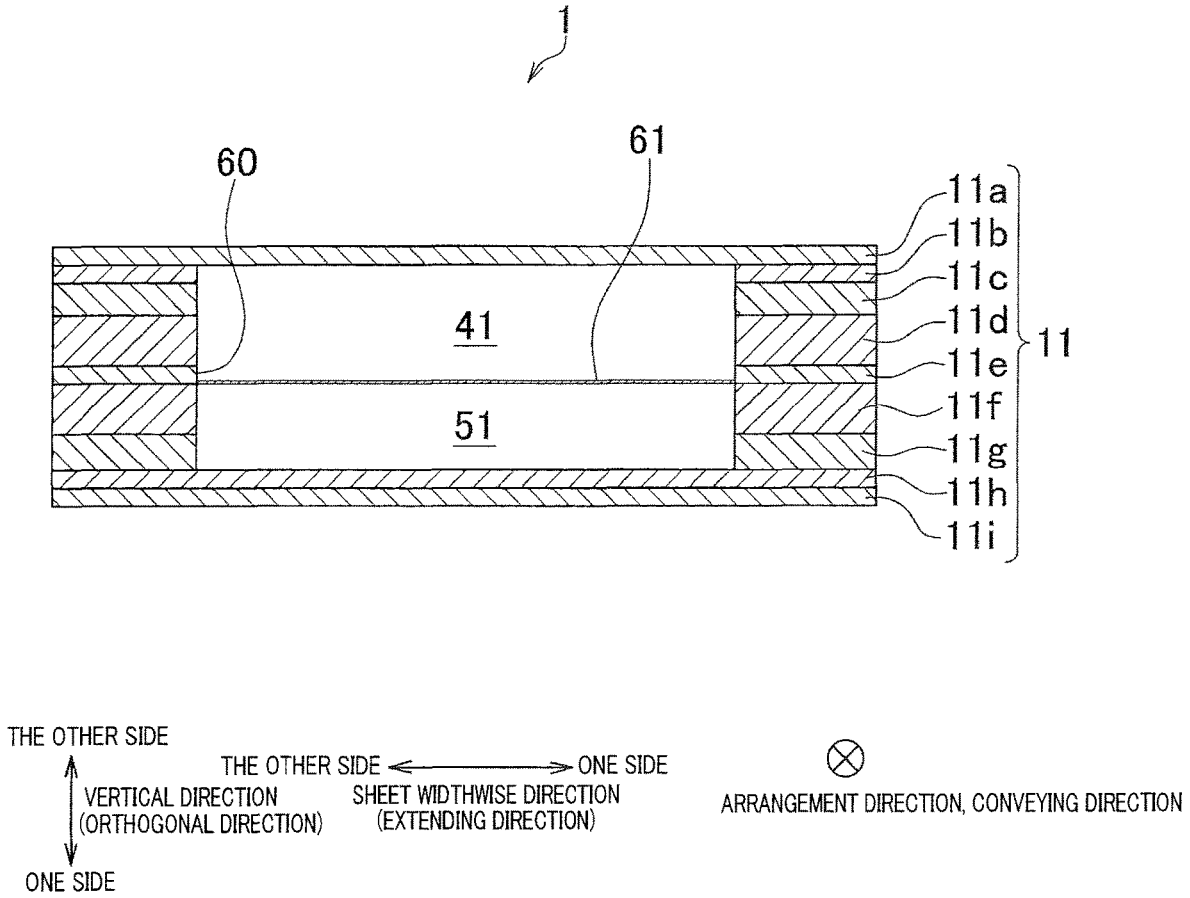

As illustrated in FIGS. 3 and 4, the liquid-passage defining plate 11 includes nine plates 11*a*-11*i* stacked on and bonded to each other. Each of the plates 11*a*-11*i* has through holes constituting liquid passages and openings formed in the liquid-passage defining plate 11.

Figure 2:
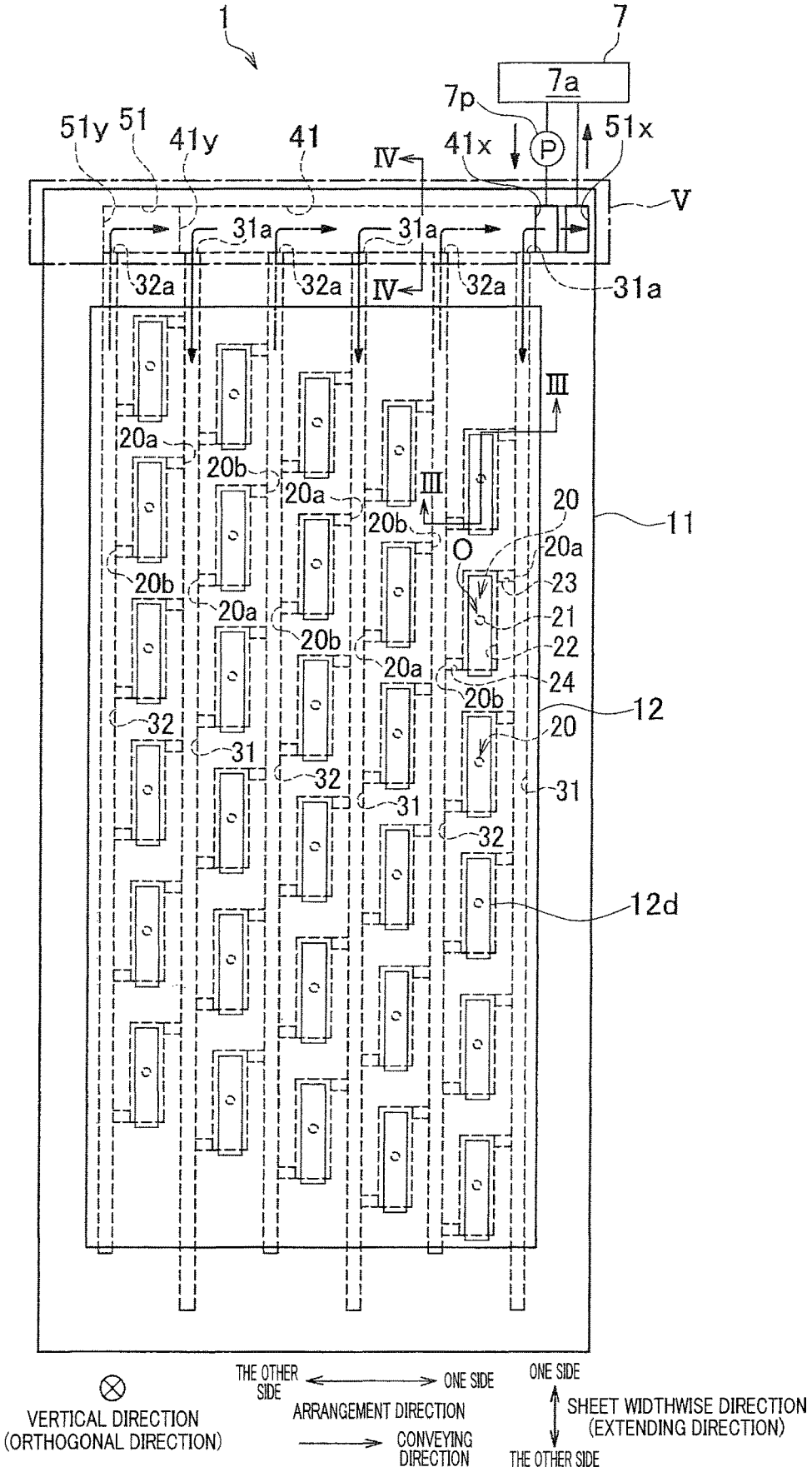
FIG. 2 is a plan view of the head 1.

As illustrated in FIG. 2, passages formed in the liquid-passage defining plate 11 include: a plurality of individual passages 20; a plurality of supply liquid passages 31 communicating with inlets 20*a* of the respective individual passages 20; a plurality of return liquid passages 32 communicating with outlets 20*b* of the respective individual passages 20; a supply coupling liquid passage 41 coupling the supply liquid passages 31 to each other; and a return coupling liquid passage 51 coupling the return liquid passages 32 to each other.

The supply liquid passages 31 and the return liquid passages 32 extend in the same direction that coincides with the widthwise direction of the sheet 9 and may be hereinafter referred to as "extending direction". The supply liquid passages 31 and the return liquid passages 32 are arranged in a direction along the conveying direction which may be hereinafter referred to as "arrangement direction". In the present embodiment, the arrangement direction is orthogonal to the extending direction. The supply liquid passages 31 and the return liquid passages 32 are arranged alternately in the arrangement direction.

Each of the supply liquid passages 31 communicates with the supply coupling liquid passage 41 via an inlet 31*a* formed at a one-side end portion of the supply liquid passage 31 in the extending direction. Each of the return liquid passages 32 communicates with the return coupling liquid passage 51 via an outlet 32*a* formed at a one-side end portion of the return liquid passage 32 in the extending direction.

The supply coupling liquid passage 41 communicates at its other-side surface in the extending direction with the inlets 31*a* of the respective supply liquid passages 31. The return coupling liquid passage 51 communicates at its other-side surface in the extending direction with the outlets 32*a* of the respective return liquid passages 32.

Each of the supply coupling liquid passage 41 and the return coupling liquid passage 51 extends in the arrangement direction and is located on the one side of the supply liquid passages 31 and the return liquid passages 32 in the extending direction. The supply coupling liquid passage 41 and the return coupling liquid passage 51 overlap each other in the vertical direction (hereinafter may be referred to as "orthogonal direction") that is orthogonal to the extending direction and the arrangement direction.

The supply coupling liquid passage 41 extends in the arrangement direction from a supply opening 41*x* formed in a one-side end portion of the supply coupling liquid passage 41 in the arrangement direction, to an other-side end portion 41*y* of the supply coupling liquid passage 41 in the arrangement direction. The return coupling liquid passage 51 extends in the arrangement direction from a return opening 51*x* formed in a one-side end portion of the return coupling liquid passage 51 in the arrangement direction, to an other-side end portion 51*y* of the return coupling liquid passage 51 in the arrangement direction. The length of the supply coupling liquid passage 41 in the arrangement direction is less than that of the return coupling liquid passage 51 in the arrangement direction. In the present embodiment, the overlapping portion (as one example of a first overlapping portion) at which the supply coupling liquid passage 41 and the return coupling liquid passage 51 overlap each other in the orthogonal direction corresponds to a region of the supply coupling liquid passage 41 on the plane orthogonal to the orthogonal direction. It is noted that when describing the configuration in which the supply coupling liquid passage 41 and the return coupling liquid passage 51 overlap each other in the orthogonal direction at the overlapping portion in other words, the supply coupling liquid passage 41 and the return coupling liquid passage 51 have the overlapping portion at which the supply coupling liquid passage 41 and the return coupling liquid passage 51 overlap each other when viewed in the orthogonal direction.

The supply coupling liquid passage 41 communicates with a storage chamber 7*a* of a sub-tank 7 via the supply opening 41*x*. The supply opening 41*x* is formed at the one-side end portion of the supply coupling liquid passage 41 in the arrangement direction and is located on one side of coupled portions of the respective supply liquid passages 31 (the inlets 31*a* of the respective supply liquid passages 31) in the arrangement direction. The return coupling liquid passage 51 communicates with the storage chamber 7*a* via the return opening 51*x*. The return opening 51*x* is formed at the one-side end portion of the return coupling liquid passage 51 in the arrangement direction and is located on the one side of coupled portions of the respective return liquid passages 32 (the outlets 32*a* of the respective return liquid passages 32) in the arrangement direction.

The sub-tank 7 is installed in the head 1. The storage chamber 7*a* communicates with a main tank, not illustrated, for storing the ink and stores the ink supplied from the main tank.

Each of the individual passages 20 is formed between a corresponding one of the supply liquid passages 31 and a corresponding one of the return liquid passages 32 which are adjacent to each other in the arrangement direction. The individual passages 20 are arranged in five rows, in each of which the individual passages 20 each extending in the extending direction are arranged in the extending direction. The five rows are arranged in the arrangement direction. The supply liquid passage 31 and the return liquid passage 32 are formed on opposite sides of each of the rows of the individual passages 20 in the arrangement direction. In the present embodiment, the supply liquid passage 31 or the return liquid passage 32 formed between two of the rows of the individual passages 20 which are adjacent to each other in the arrangement direction communicates with the individual passages 20 belonging to the two rows.

As illustrated in FIGS. 2 and 3, each of the individual passages 20 includes: the nozzle 21; a pressure chamber 22 communicating with the nozzle 21; an inflow passage 23 connecting the pressure chamber 22 and the inlet 20*a* to each other; and an outflow passage 24 connecting the pressure chamber 22 and the outlet 20*b* to each other. As illustrated in FIG. 2, the pressure chamber 22 is of a rectangular shape extending in the extending direction on the plane extending along the extending direction and the arrangement direction. The pressure chamber 22 has four corner portions and four sides. The nozzle 21 is located just under the pressure chamber 22 at the center point O of the pressure chamber 22 on the plane. The inflow passage 23 and the outflow passage 24 extend in the arrangement direction respectively from two of the four sides of the pressure chamber 22, which two are opposed to each other in the arrangement direction. The inflow passage 23 and the outflow passage 24 connected respectively to two of the four corner portions of the pressure chamber 22, which two are symmetric with respect to the center point O. The inflow passage 23 and the outflow passage 24 are arranged so as to be symmetric with respect to the center point O. Likewise, the inlet 20*a* and the outlet 20*b* are arranged so as to be symmetric with respect to the center point O.

As illustrated in FIG. 3, the nozzle 21 is constituted by through holes formed in the respective plates 11*h*, 11*i*. The pressure chamber 22 is constituted by through holes formed in the respective plates 11*a*-11*g*. The inflow passage 23 is constituted by a through hole formed in the plate 11*c*. The outflow passage 24 is constituted by a through hole formed in the plate 11*g*. The nozzle 21 is located at a lower end portion of each of the individual passages 20 in the vertical direction (a one-side end portion of each of the individual passages 20 in the orthogonal direction).

The supply liquid passage 31 is constituted by through holes formed in the respective plates 11*c*, 11*d*. The return liquid passage 32 is constituted by through holes formed in the respective plates 11*f*, 11*g*. The return liquid passages 32 are located below the supply liquid passages 31 in the vertical direction. In other words, the return liquid passages 32 are located on one side of the supply liquid passages 31 in the orthogonal direction.

Damper films 35 are provided in the respective supply liquid passages 31. Damper films 37 are provided in the respective return liquid passages 32. Each of the damper films 35 defines a lower surface of a corresponding one of the supply liquid passages 31. Each of the damper films 37 defines an upper surface of a corresponding one of the return liquid passages 32. Specifically, the plate 11*e* has: a through hole serving as a damper chamber 34 at a region located under the supply liquid passage 31; and a through hole serving as a damper chamber 36 at a region located over the return liquid passage 32. The damper film 35 is mounted on an upper surface of the plate 11*e* so as to cover the damper chamber 34, and the damper film 37 is mounted on a lower surface of the plate 11*e* so as to cover the damper chamber 36.

As illustrated in FIG. 4, the supply coupling liquid passage 41 is constituted by through holes formed in the respective plates 11*c*-11*e*. The return coupling liquid passage 51 is constituted by through holes formed in the respective plates 11*f*, 11*g*. The return coupling liquid passage 51 is located under the supply coupling liquid passage 41 in the vertical direction. In other words, the return coupling liquid passage 51 is located on the one side of the supply coupling liquid passage 41 in the orthogonal direction. The length of the return coupling liquid passage 51 is less than that of the supply coupling liquid passage 41 in the orthogonal direction.

Figure 5:
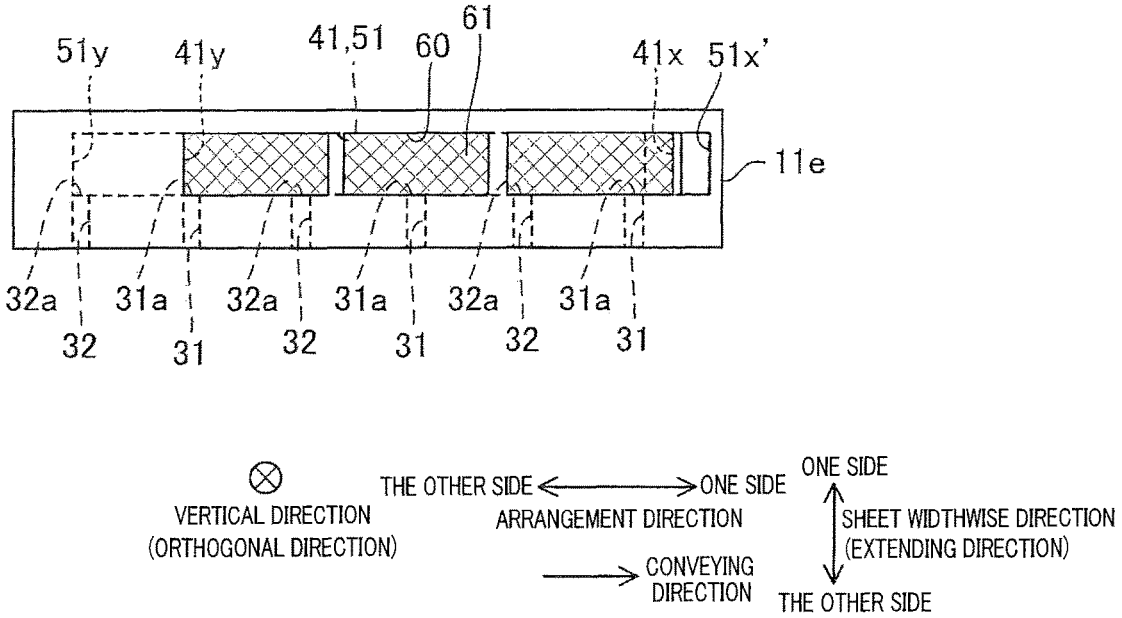
FIG. 5 is a plan view of a plate 11*e* constituting a liquid-passage defining plate 11 of the head 1 at a region Vin FIG. 2.

At the overlapping portion of the supply coupling liquid passage 41 and the return coupling liquid passage 51, as illustrated in FIGS. 4 and 5, three damper films 61 spaced apart from each other in the arrangement direction are located between the supply coupling liquid passage 41 and the return coupling liquid passage 51 in the orthogonal direction. Each of the damper films 61 is in contact with the supply coupling liquid passage 41 and the return coupling liquid passage 51 so as to define a lower surface of the supply coupling liquid passage 41 and an upper surface of the return coupling liquid passage 51. Specifically, three through holes 60 are formed in the plate 11*e*. The damper films 61 are mounted on a lower surface of the plate 11*e* so as to cover the respective through holes 60.

Each of the damper films 35, 37, 61 is a film-like member with a thickness that is less than that of each of the plates 11*a*-11*i*. The damper films 61 are hatched in FIG. 5.

As illustrated in FIG. 5, the three damper films 61 are provided at a region extending in the arrangement direction and containing the inlets 31*a* of the respective supply liquid passages 31 and the outlets 32*a* of the respective return liquid passages 32. In other words, the region at which the three damper films 61 are arranged in the arrangement direction includes a region in which at least one of the inlets 31*a* of the respective supply liquid passages 31 and the outlets 32*a* of the respective return liquid passages 32 is formed in the arrangement direction. Here, the region at which the three damper films 61 are arranged in the arrangement direction means a region between a position of one end of the three damper films 61 in the arrangement direction (e.g., the right end of the damper films 61 in FIG. 5) and a position of the other end of the three damper films 61 in the arrangement direction (the left end of the damper films 61 in FIG. 5). Accordingly, for example, in the case where the right end of the three damper films 61 is located to the right of the right end of the inlets 31*a* of the respective supply liquid passages 31 in FIG. 5, and the left end of the three damper films 61 is located to the left of the left end of the inlets 31*a* of the respective supply liquid passages 31 in FIG. 5, the region at which the three damper films 61 are arranged in the arrangement direction includes a region in which the inlets 31*a* of the respective supply liquid passages 31 are formed in the arrangement direction. The damper film 61 located on the one side of the other two damper films 61 in the arrangement direction extends to the supply opening 41*x*. The supply opening 41*x* is located just above the damper film 61. In other words, the region at which the three damper films 61 are arranged in the arrangement direction includes at least a portion of a region in which the supply opening 41*x* is formed in the arrangement direction. For example, in the case where the right end of the three damper films 61 is located to the right of the left end of the supply opening 41*x* in FIG. 5, the region at which the three damper films 61 are arranged in the arrangement direction includes at least a portion of the region in which the supply opening 41*x* is formed in the arrangement direction. Any one of the three damper films 61 is provided at each of portions of the supply coupling liquid passage 41 which communicate with the respective inlets 31*a* of the supply liquid passages 31 and portions of the return coupling liquid passage 51 which communicate with the respective outlets 32*a* of the return liquid passages 32.

It is noted that the plate 11*e* also has a through hole 51*x*' continuing to the return opening 51*x*.

Here, there will be described the flow of ink in the liquid-passage defining plate 11. The arrows in FIGS. 2 and 3 indicate the flow of the ink.

As illustrated in FIG. 2, when the controller 5 drives a circulation pump 7*p*, the ink in the storage chamber 7*a* is supplied from the supply opening 41*x* to the supply coupling liquid passage 41. The ink supplied to the supply coupling liquid passage 41 flows in the supply coupling liquid passage 41 from the one side toward the other side in the arrangement direction and enters into the inlets 31*a* of the respective supply liquid passages 31. The ink having flowed in the inlets 31*a* of the respective supply liquid passages 31 flows in the supply liquid passages 31 from the one side toward the other side in the extending direction and enters into the inlets 20*a* of the respective individual passages 20.

In each of the individual passages 20, as illustrated in FIG. 3, the ink having flowed from the supply liquid passage 31 into the inlet 20*a* enters into the pressure chamber 22 through the inflow passage 23, and a portion of the ink is ejected from the nozzle 21 while the remaining ink flows from the outlet 20*b* into the return liquid passage 32 through the outflow passage 24.

As illustrated in FIG. 2, the ink having flowed in the return liquid passages 32 flows in the return liquid passages 32 from the other side toward the one side in the extending direction and enters from the outlets 32*a* into the return coupling liquid passage 51. The ink having flowed in the return coupling liquid passage 51 flows in the return coupling liquid passage 51 from the other side toward the one side in the arrangement direction and enters from the return opening 51*x* back into the storage chamber 7*a*.

This circulation of the ink between the storage chamber 7*a* and each of the individual passages 20 enables discharge of air bubbles from the individual passages 20 and prevents increase in viscosity of the ink. Furthermore, in the case where the ink contains components with a possibility of settling, such as pigments, the components are stirred, thereby preventing settling of the components.

The actuator unit 12 is disposed on an upper surface of the liquid-passage defining plate 11 so as to cover the pressure chambers 22.

As illustrated in FIG. 3, the actuator unit 12 includes a vibration plate 12*a*, a common electrode 12*b*, a plurality of piezoelectric elements 12*c*, and a plurality of individual electrodes 12*d* stacked in order from below. The vibration plate 12*a* and the common electrode 12*b* cover the pressure chambers 22. Each of the piezoelectric elements 12*c* and each of the individual electrodes 12*d* are provided for a corresponding one of the pressure chambers 22 so as to be opposed to the corresponding pressure chamber 22 in the orthogonal direction.

The individual electrodes 12*d* and the common electrode 12*b* are electrically connected to the driver IC 1*d*. The driver IC 1*d* keeps the electric potential of the common electrode 12*b* at the ground potential and changes the electric potential of each of the individual electrodes 12*d*. Specifically, the driver IC 1*d* creates drive signals based on control signals output from the controller 5 and transmits the drive signals to the individual electrodes 12*d*. As a result, the electric potential of each of the individual electrodes 12*d* is changed between a predetermined driving potential and the ground potential. In this operation, for each of the piezoelectric elements 12*c*, portions of the vibration plate 12*a* and the piezoelectric element 12*c* which are located between a corresponding one of the individual electrodes 12*d* and a corresponding one of the pressure chambers 22 are deformed so as to protrude toward the pressure chamber 22. This changes the volume of the pressure chamber 22, so that a pressure is applied to the ink in the pressure chamber 22 to eject the ink from a corresponding one of the nozzles 21.

In the present embodiment as described above, the supply coupling liquid passage 41 and the return coupling liquid passage 51 are located on the one side of the supply liquid passages 31 and the return liquid passages 32 in the extending direction and have the overlapping portion at which the supply coupling liquid passage 41 and the return coupling liquid passage 51 at least partly overlap each other in the orthogonal direction (see FIG. 2). This configuration reduces a region required for arrangement of the liquid passages in the extending direction and thereby reduces the size of the head 1 when compared with the case where the supply coupling liquid passage 41 and the return coupling liquid passage 51 are located on each of opposite sides of the plurality of supply liquid passages 31 and the plurality of return liquid passages 32 in the extending direction and the case where the supply coupling liquid passage 41 and the return coupling liquid passage 51 are located on the one side of the supply liquid passages 31 and the return liquid passages 32 in the extending direction but do not overlap each other in the orthogonal direction. In the present embodiment, the damper films 61 are provided between the supply coupling liquid passage 41 and the return coupling liquid passage 51 in the orthogonal direction at the overlapping portion (see FIG. 4). The above-described configuration also reduces the manufacturing cost required for providing the damper films when compared with a case where damper films are provided for each of the two coupling liquid passages 41, 51. Thus, in the present embodiment, it is possible to reduce the size of the head 1 in the extending direction and reduce the manufacturing cost required for providing the damper films.

The nozzle 21 is located at the lower end portion of each of the individual passages 20 in the vertical direction (the one end portion thereof in the orthogonal direction) (see FIG. 3). The return coupling liquid passage 51 is located under the supply coupling liquid passage 41 in the vertical direction (see FIG. 4). In other words, the return coupling liquid passage 51 is located on the one side of the supply coupling liquid passage 41 in the orthogonal direction. Since the return coupling liquid passage 51 and the nozzle 21 of each of the individual passages 20 are located on the same side (the lower side), it is easy to discharge air bubbles existing near the nozzles 21 from the respective individual passages 20 via the return coupling liquid passage 51. The supply coupling liquid passage 41 is located on an opposite side from the nozzles 21 of the respective individual passages 20. With this configuration, the ink supplied from the supply coupling liquid passage 41 to the individual passages 20 smoothly flows toward the respective nozzles, causing ejection of the ink from the nozzle 21 with reduced driving force for the ejection.

The three damper films 61 are provided over the region extending in the arrangement direction and containing the inlets 31*a* of the respective supply liquid passages 31 and the outlets 32*a* of the respective return liquid passages 32 (see FIG. 5). This configuration reduces fluid crosstalk between the supply liquid passages 31 and between the return liquid passages 32.

The damper film 61 located on the one side of the other two damper films 61 in the arrangement direction extends to the supply opening 41*x* (see FIG. 5). This effectively reduces fluctuations of pressure due to the ink having entered from the supply openings 41*x*.

If one damper film elongated in the arrangement direction is provided between the supply coupling liquid passage 41 and the return coupling liquid passage 51 in the orthogonal direction, it is difficult to adjust the damping performance. It is difficult to evenly bond the one damper film elongated in the arrangement direction, and the volume of the liquid passage may change depending upon the flatness of the damper film. In the present embodiment, the three damper films 61 spaced apart from each other in the arrangement direction are provided between the supply coupling liquid passage 41 and the return coupling liquid passage 51 in the orthogonal direction (see FIG. 5). Thus, the damping performance is easily adjusted depending upon the individual characteristic of the three damper films 61. Since each of the three damper films 61 has a relatively small length in the arrangement direction, it is possible to reduce the difficulty of bonding and a problem in which there is a possibility of change in the volume of the liquid passage.

If not the damper films 61 but walls each between corresponding adjacent two of the damper films 61 (portions of the plate 11*e* which define the respective through holes 60) are provided at the portions of the supply coupling liquid passage 41 which communicate with the respective inlets 31*a* of the supply liquid passages 31 and the portions of the return coupling liquid passage 51 which communicate with the respective outlets 32*a* of the return liquid passages 32, it is difficult to achieve effects of damping pressure waves for the supply liquid passages 31 and the return liquid passages 32. In the present embodiment, in contrast, any of the three damper films 61 is provided on each of the portions of the supply coupling liquid passage 41 which communicate with the respective inlets 31*a* of the supply liquid passages 31 and the portions of the return coupling liquid passage 51 which communicate with the respective outlets 32*a* of the return liquid passages 32 (see FIG. 5). This configuration reliably achieves the effects of damping the pressure waves for the supply liquid passages 31 and the return liquid passages 32.

The single damper film 61 being in contact with the supply coupling liquid passage 41 and the return coupling liquid passage 51 is provided between the supply coupling liquid passage 41 and the return coupling liquid passage 51 in the orthogonal direction (see FIG. 4). As a result, deviation of the pressure waves occurs between the supply coupling liquid passage 41 and the return coupling liquid passage 51, thereby canceling out the pressure waves.

If the supply opening 41*x* is located on the one side of the coupled portions of the respective supply liquid passages 31 in the arrangement direction, and the return opening 51*x* is located on the other side of the coupled portions of the respective return liquid passages 32 in the arrangement direction, the pressure applied to each of the inlets 20*a* and the outlets 20*b* of the individual passages 20 increases with decrease in distance to the supply opening 41*x* in the arrangement direction, and the pressure applied to each of the inlets 20*a* and the outlets 20*b* of the individual passages 20 decreases with increase in distance to the supply opening 41*x* in the arrangement direction (i.e., with decrease in distance to the return opening 51*x*). This results in a larger distribution of the pressure applied to each of the individual passages 20, leading to a case where a meniscus of the ink is not maintained. In the present embodiment, in contrast, as illustrated in FIG. 2, the supply opening 41*x* is located on the one side of the coupled portions of the respective supply liquid passages 31 in the arrangement direction, and the return opening 51*x* is located on the one side of the coupled portions of the respective return liquid passages 32 in the arrangement direction, making it possible to reduce the above-described problems.

In the present embodiment, the supply coupling liquid passage 41 and the return coupling liquid passage 51 at least partly overlap each other in the orthogonal direction, leading to increase in size of the head 1 in the orthogonal direction. To reduce this problem, it is possible to consider reducing the respective lengths of the supply coupling liquid passage 41 and the return coupling liquid passage 51 in the orthogonal direction. However, in the case where both the respective lengths of the supply coupling liquid passage 41 and the return coupling liquid passage 51 in the orthogonal direction are reduced or in the case where the length of the supply coupling liquid passage 41 in the orthogonal direction is reduced, a problem such as non-ejection due to lack of ink supply to the individual passages 20 may arise. In the present embodiment, in contrast, the length of the return coupling liquid passage 51 is less than that of the supply coupling liquid passage 41 in the orthogonal direction (see FIG. 4). The amount of the ink flowing in the return coupling liquid passage 51 is less than the liquid flowing in the supply coupling liquid passage 41 by an amount corresponding to ejection of the ink from the nozzles 21. Thus, even in the case where the length of the return coupling liquid passage 51 in the orthogonal direction is reduced, it is difficult to cause the problem such as non-ejection. Accordingly, in the present embodiment, it is possible to reduce increase in size of the head 1 in the orthogonal direction while reducing the problem such as non-ejection.

Second Embodiment

Figure 7:
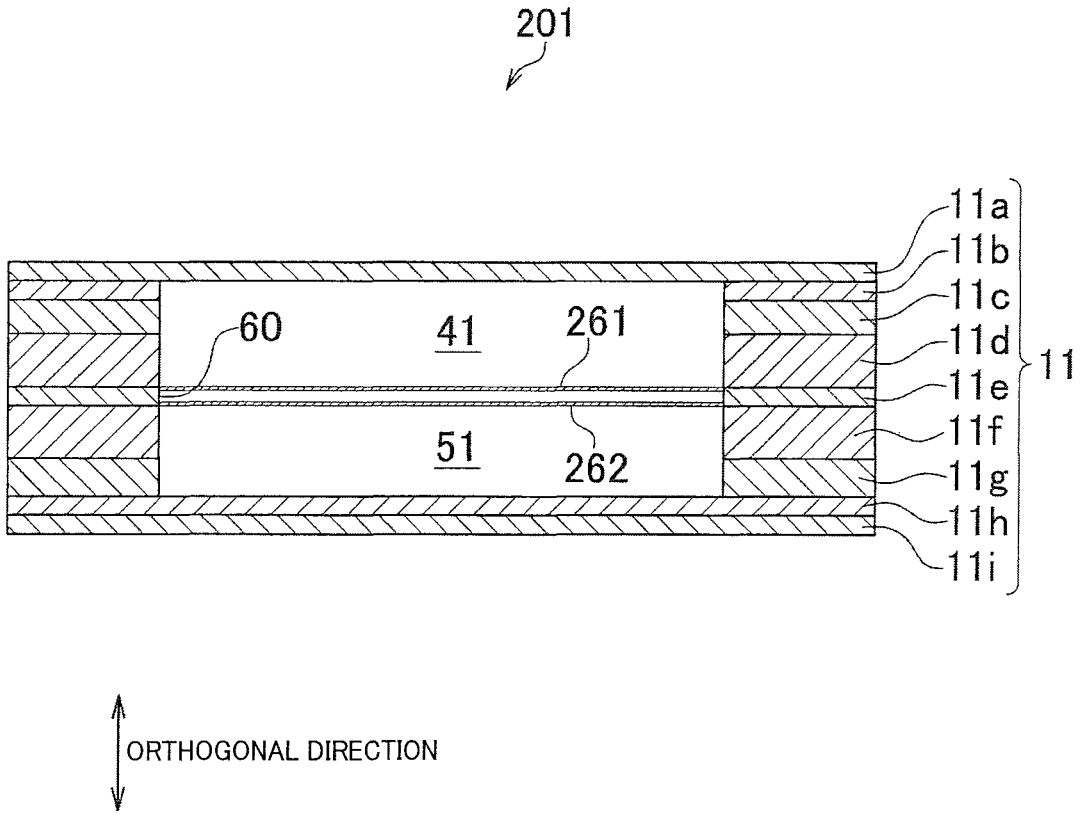
FIG. 7 is a cross-sectional view of a head 201 according to a second embodiment, the view corresponding to FIG. 4.

There will be next described a head 201 according to a second embodiment with reference to FIG. 7. The present embodiment is different from the first embodiment in configuration of the damper film provided between the supply coupling liquid passage 41 and the return coupling liquid passage 51.

In the first embodiment, the single damper film 61 being in contact with the supply coupling liquid passage 41 and the return coupling liquid passage 51 is provided between the supply coupling liquid passage 41 and the return coupling liquid passage 51 in the orthogonal direction (see FIG. 4).

In the present embodiment, damper films 261, 262 spaced apart from each other in the orthogonal direction are provided between the supply coupling liquid passage 41 and the return coupling liquid passage 51 in the orthogonal direction. The damper films 261, 262 are provided respectively on the upper and lower surfaces of the plate 11*e* so as to cover the through holes 60. In the present embodiment, the respective lengths of the supply coupling liquid passage 41 and the return coupling liquid passage 51 in the orthogonal direction are equal to each other.

In the present embodiment, a space between the damper films 261, 262 achieves the effects of damping the pressure waves.

Third Embodiment

Figure 8:
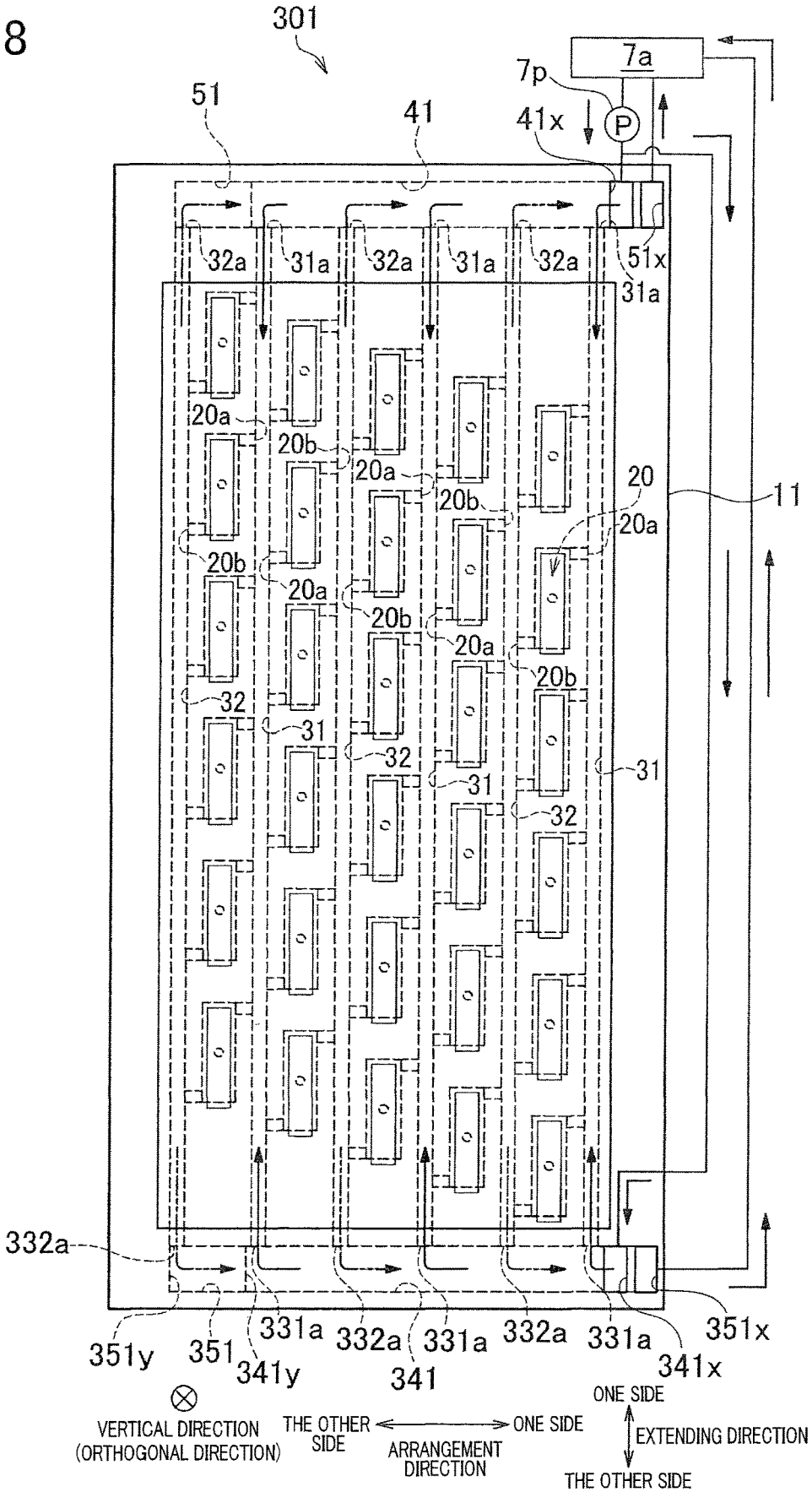
FIG. 8 is a plan view of a head 301 according to a third embodiment.

There will be next described a head 301 according to a third embodiment with reference to FIG. 8. The present embodiment is different from the first embodiment in that two pairs of the supply coupling liquid passages and the return coupling liquid passages are formed.

In the first embodiment, the supply coupling liquid passage 41 and the return coupling liquid passage 51 are provided on the one side of the supply liquid passages 31 and the return liquid passages 32 in the extending direction (see FIG. 2).

In the present embodiment, a supply coupling liquid passage 341 and a return coupling liquid passage 351 are provided on the other side of the supply liquid passages 31 and the return liquid passages 32 in the extending direction in addition to the supply coupling liquid passage 41 and the return coupling liquid passage 51 in the first embodiment. Like the supply coupling liquid passage 41 and the return coupling liquid passage 51, the supply coupling liquid passage 341 and the return coupling liquid passage 351 extend in the arrangement direction and overlap each other in the orthogonal direction.

The supply coupling liquid passage 341 extends in the arrangement direction from a supply opening 341*x* formed in a one-side end portion of the supply coupling liquid passage 341 in the arrangement direction, to an other-side end portion 341*y* of the supply coupling liquid passage 341 in the arrangement direction. The return coupling liquid passage 351 extends in the arrangement direction from a return opening 351*x* formed in a one-side end portion of the return coupling liquid passage 351 in the arrangement direction, to an other-side end portion 351*y* of the return coupling liquid passage 351 in the arrangement direction. The length of the supply coupling liquid passage 341 in the arrangement direction is less than that of the return coupling liquid passage 351 in the arrangement direction. In the present embodiment, an overlapping portion (as one example of a second overlapping portion) at which the supply coupling liquid passage 341 and the return coupling liquid passage 351 overlap each other in the orthogonal direction corresponds to a region of the supply coupling liquid passage 341 on the plane orthogonal to the orthogonal direction.

The supply coupling liquid passage 341 couples the supply liquid passages 31 to each other and communicates with inlets 331*a* of the respective supply liquid passages 31. The return coupling liquid passage 351 couples the return liquid passages 32 to each other and communicates with outlets 332*a* of the respective return liquid passages 32.

Each of the supply liquid passages 31 communicates with the supply coupling liquid passage 41 via the corresponding one of the inlets 31*a* formed in the one-side end portion of the supply liquid passage 31 in the extending direction and communicates with the supply coupling liquid passage 341 via a corresponding one of the inlets 331*a* formed in an other-side end portion of the supply liquid passage 31 in the extending direction. In each of the supply liquid passages 31, the inlets 20*a* of the respective individual passages 20 are formed between the inlet 31*a* and the inlet 331*a*.

Each of the return liquid passages 32 communicates with the return coupling liquid passage 51 via the corresponding one of the outlets 32*a* formed in the one-side end portion of the return liquid passage 32 in the extending direction and communicates with the return coupling liquid passage 351 via a corresponding one of the outlets 332*a* formed in an other-side end portion of the return liquid passage 32 in the extending direction. In each of the return liquid passages 32, the outlets 20*b* of the respective individual passages 20 are formed between the outlet 32*a* and the outlet 332*a*.

The supply coupling liquid passage 341 communicates with the storage chamber 7*a* via the supply opening 341*x*. The supply opening 341*x* is located on the one side of coupled portions of the respective supply liquid passages 31 (the inlets 331*a* of the respective supply liquid passages 31) in the arrangement direction.

The return coupling liquid passage 351 communicates with the storage chamber 7*a* via the return opening 351*x*. The return opening 351*x* is located on the one side of coupled portions of the respective return liquid passages 32 (the outlets 332*a* of the respective return liquid passages 32) in the arrangement direction.

When the circulation pump 7*p* is driven by the controller 5, the ink in the storage chamber 7*a* is supplied from the supply opening 41*x* to the supply coupling liquid passage 41 and from the supply opening 341*x* to the supply coupling liquid passage 341. The ink supplied to the supply coupling liquid passage 41 flows in the supply coupling liquid passage 41 from the one side to the other side in the arrangement direction and enters into the inlets 31*a* of the respective supply liquid passages 31. The ink supplied to the supply coupling liquid passage 341 flows in the supply coupling liquid passage 41 from the one side to the other side in the arrangement direction and enters into the inlets 331*a* of the respective supply liquid passages 31. The ink having flowed in the inlets 31*a* of the respective supply liquid passages 31 flows in the supply liquid passages 31 from the one side to the other side in the extending direction and enters into the inlets 20*a* of the respective individual passages 20. The ink having flowed in the inlets 331*a* of the respective supply liquid passages 31 flows in the supply liquid passages 31 from the other side toward the one side in the extending direction and enters into the inlets 20*a* of the respective individual passages 20.

In each of the individual passages 20, as illustrated in FIG. 3, the ink having flowed from the supply liquid passage 31 into the inlet 20*a* enters into the pressure chamber 22 through the inflow passage 23, and a portion of the ink is ejected from the nozzle 21 while the remaining ink flows from the outlet 20*b* into the return liquid passage 32 through the outflow passage 24.

As illustrated in FIG. 8, the ink having flowed in each of the return liquid passages 32 flows in the return liquid passage 32 from the other side toward the one side in the extending direction and enters from the outlet 32*a* into the return coupling liquid passage 51 or flows in the return liquid passage 32 from the one side to the other side in the extending direction and enters from the outlet 332*a* into the return coupling liquid passage 351.

The ink having flowed in the return coupling liquid passage 51 flows in the return coupling liquid passage 51 from the other side toward the one side in the arrangement direction and enters from the return opening 51*x* back into the storage chamber 7*a*. The ink having flowed in the return coupling liquid passage 351 flows in the return coupling liquid passage 51 from the other side toward the one side in the arrangement direction and enters from the return opening 51*x* back into the storage chamber 7*a*.

Like the damper films 61 being provided at the overlapping portion of the supply coupling liquid passage 41 and the return coupling liquid passage 51, three damper films spaced apart from each other in the arrangement direction are provided between the supply coupling liquid passage 341 and the return coupling liquid passage 351 in the orthogonal direction at the overlapping portion of the supply coupling liquid passage 341 and the return coupling liquid passage 351 (see FIGS. 4 and 5). The supply coupling liquid passages 41, 341 are symmetric, the return coupling liquid passages 51, 351 are symmetric, and the damper films 61 provided between the supply coupling liquid passage 41 and the return coupling liquid passage 51 and the damper films provided between the supply coupling liquid passage 341 and the return coupling liquid passage 351 are symmetric on the plane along the arrangement direction and the orthogonal direction which extends through the center of the liquid-passage defining plate 11 in the extending direction.

The head 301 of the present embodiment as described above includes the supply coupling liquid passage 341 and the return coupling liquid passage 351 in addition to the supply coupling liquid passage 41 and the return coupling liquid passage 51. Thus, the ink is supplied to each of the supply liquid passages 31 from both of the inlet 31*a* and the inlet 331*a*. In this case, the pressure applied to each of the individual passages 20 communicating with each of the supply liquid passages 31 increases with decrease in distance to the inlet 31*a* or the inlet 331*a*, but variations of the applied pressure are reduced when compared with the case where the ink is supplied from one inlet of each of the supply liquid passages 31. Also, the ink is collected from both of the outlet 32*a* and the outlet 332*a* in each of the return liquid passages 32. In this case, the pressure applied to each of the individual passages 20 communicating with each of the return liquid passages 32 increases with increase in distance to the outlet 32*a* or the outlet 332*a*, but variations of the applied pressure are reduced when compared with the case where the ink is collected from one outlet of each of the return liquid passages 32.

In the present embodiment, the supply coupling liquid passage 341 and the return coupling liquid passage 351 are located on the other side of the plurality of supply liquid passages 31 and the plurality of return liquid passages 32 in the extending direction and includes the overlapping portion at which the supply coupling liquid passage 341 and the return coupling liquid passage 351 at least partly overlap each other in the orthogonal direction. This configuration reduces the region required for arrangement of the liquid passages in the extending direction and thereby reduces the head 301 when compared with a case where the supply coupling liquid passage 341 and the return coupling liquid passage 351 do not overlap each other in the orthogonal direction. In the present embodiment, the damper films are provided between the supply coupling liquid passage 341 and the return coupling liquid passage 351 in the orthogonal direction at the second overlapping portion (see FIG. 4). This configuration reduces the manufacturing cost required for providing the damper films when compared with the case where damper films are provided for each of the coupling liquid passages 341, 351.

MODIFICATIONS

While the embodiments have been described above, it is to be understood that the disclosure is not limited to the details of the illustrated embodiments, but may be embodied with various changes and modifications, which may occur to those skilled in the art, without departing from the spirit and scope of the disclosure.

In the above-described embodiments, the overlapping portion at which the supply coupling liquid passage and the return coupling liquid passage overlap each other in the orthogonal direction corresponds to the region of the supply coupling liquid passage on the plane orthogonal to the orthogonal direction, but the present disclosure is not limited to this configuration. That is, the supply coupling liquid passage and the return coupling liquid passage only have to at least partly overlap each other in the orthogonal direction. Thus, the supply coupling liquid passage and the return coupling liquid passage may be slightly different from each other in position in the extending direction, for example.

The number and positions of the supply openings and the return openings are not limited in particular. For example, the above-described embodiment (FIG. 2), the head may be configured such that the supply opening 41*x* is located on the one side of the coupled portions of the respective supply liquid passages 31 in the arrangement direction, and the return opening 51*x* is located on the other side of the coupled portions of the respective return liquid passages 32 in the arrangement direction. The head may be configured such that each of the supply opening and the return opening is formed at the center of a corresponding one of the supply coupling liquid passage and the return coupling liquid passage (i.e., the center thereof in a direction in which the liquid passage extends). A plurality of supply openings may be formed in the supply coupling liquid passage, and a plurality of return openings may be formed in the return coupling liquid passage. The supply opening 41*x* and the return opening 51*x* are formed in the upper surface of the liquid-passage defining plate 11 in the above-described embodiment but may be formed in a side surface of the liquid-passage defining plate 11.

The damper films provided between the supply coupling liquid passage and the return coupling liquid passage may not extend to the supply opening and may extend to the return opening and may extend to both of the supply opening and the return opening. For example, in the case where the supply opening 41*x* and the return opening 51*x* are formed in the side surface of the liquid-passage defining plate 11, the damper films provided between the supply coupling liquid passage and the return coupling liquid passage can be extended to both of the supply opening and the return opening.

While a plurality of damper films spaced apart from each other in the arrangement direction are provided in the above-described embodiments, the present disclosure is not limited to this configuration. For example, one or two damper films each elongated in the arrangement direction may be provided.

No damper film may be provided on each of the supply liquid passages and the return liquid passages.

The positional relationship among the coupling liquid passages, the supply liquid passages, and the return liquid passages in the orthogonal direction is not limited in particular. For example, the supply coupling liquid passages and the return coupling liquid passages may be located at the same position in the orthogonal direction. The supply coupling liquid passages may be located below the return coupling liquid passages, in other words, the supply coupling liquid passages may be located on the one side of the return coupling liquid passages in the orthogonal direction. The supply liquid passages and the return liquid passages may be located at the same position in the orthogonal direction. The supply liquid passages may be located below the return liquid passages.

In the above-described embodiment (FIG. 2), the supply liquid passage 31 or the return liquid passage 32 formed between two of the rows of the individual passages 20 which are adjacent to each other in the arrangement direction communicates with the individual passages 20 belonging to the two rows. However, the present disclosure is not limited to this configuration. For example, a pair of the supply liquid passage 31 and the return liquid passage 32 may be formed for each row of the individual passages 20.

Each of the number of the supply liquid passages and the number of the return liquid passages at least needs to be two or more.

The individual passages need not be arranged in rows and may be arranged on a random basis.

The configuration of each of the individual passages (e.g., the shape of the pressure chamber and a manner of communication between the pressure chamber and the nozzle) is not limited in particular. For example, the pressure chamber may have any shape on the plane extending along the extending direction and the arrangement direction, such as a square, a parallelogram, a rhombus, a perfect circle, and an oval. While the pressure chamber is formed just above the nozzle in the above-described embodiments, the present disclosure is not limited to this configuration. For example, another liquid passage establishing communication between the pressure chamber and the nozzle may be formed. Each of the number of the nozzles and the number of the pressure chambers in each of the individual passages is not limited to one and may be two or more.

The positions of the inlet and the outlet in each of the individual passages are not limited in particular. For example, while the inlet 20*a* and the outlet 20*b* are arranged so as to be symmetric with respect to the center point O of the pressure chamber 22 in the above-described embodiment (FIG. 2), the inlet 20*a* and the outlet 20*b* may be arranged so as to be symmetric with respect to an axis extending in the extending direction through the center of the pressure chamber 22 in the arrangement direction. The inlet 20*a* and the outlet 20*b* may be located at the same position in the orthogonal direction. The inlet 20*a* may be located below the outlet 20*b*. In the above-described embodiment, the inflow passage 23 and the outflow passage 24 extend in the arrangement direction respectively from the two surfaces of the pressure chamber 22 which are opposed to each other in the arrangement direction. However, the inflow passage 23 and the outflow passage 24 may extend respectively from two surfaces of the pressure chamber 22 which are opposed to each other in the extending direction, then be bent or curved, and finally connected respectively to the supply liquid passage 31 and the return liquid passage 32. The inflow passage 23 and the outflow passage 24 may be located at the same position in the orthogonal direction. The inflow passage 23 may be located below the outflow passage 24.

The actuator is not limited to the piezoelectric actuator using piezoelectric elements and may be of any other type such as a thermal actuator using heating elements and an electrostatic actuator using an electrostatic force.

The head is not limited to the line head and may be a serial head which ejects liquid from nozzles onto a recording medium while moving in a scanning direction parallel with the widthwise direction of the sheet.

The recording medium is not limited to the sheet and may be any of a cloth, a circuit board, and the like.

The liquid ejected from the nozzles is not limited to the ink and may be any other type of liquid such as treatment liquid that coagulates or precipitates components of the ink.

The present disclosure is applied to the printer in the above-described embodiments but may be applied to a facsimile, a copying machine, and a multi-function peripheral (MFP), for example. The present disclosure may also be applied to a liquid ejection apparatus used for purposes different from image recording. For example, the present disclosure may be applied to a liquid ejection apparatus configured to eject conductive liquid onto a substrate to form a conductive pattern on the substrate.

What is claimed is:

1. A liquid ejection head, comprising:

a plurality of individual passages each comprising a nozzle;

a plurality of supply liquid passages each communicating with an inlet of a corresponding one of the plurality of individual passages;

a plurality of return liquid passages each communicating with an outlet of a corresponding one of the plurality of individual passages;

a supply coupling liquid passage coupling the plurality of supply liquid passages to each other and communicating with an inlet of each of the plurality of supply liquid passages; and a return coupling liquid passage coupling the plurality of return liquid passages to each other and communicating with an outlet of each of the plurality of return liquid passages, wherein the plurality of supply liquid passages and the plurality of return liquid passages extend in an extending direction and are arranged in an arrangement direction intersecting the extending direction, wherein the supply coupling liquid passage and the return coupling liquid passage extend in the arrangement direction, are located on one side of the plurality of supply liquid passages and the plurality of return liquid passages in the extending direction, and comprise an overlapping portion at which the supply coupling liquid passage and the return coupling liquid passage at least partly overlap each other when viewed in an orthogonal direction orthogonal to each of the extending direction and the arrangement direction, and wherein a damper film is provided between the supply coupling liquid passage and the return coupling liquid passage in the orthogonal direction at at least a portion of the overlapping portion.

2. The liquid ejection head according to claim 1, wherein the nozzle is located at an one-side end portion of each of the plurality of individual passages in the orthogonal direction, and wherein the return coupling liquid passage is located on one side of the supply coupling liquid passage in the orthogonal direction.

3. The liquid ejection head according to claim 1, wherein the nozzle is located at a lower end portion of each of the plurality of individual passages, and wherein the return coupling liquid passage is located below the supply coupling liquid passage.

4. The liquid ejection head according to claim 1, wherein a region in the arrangement direction at which the damper film is provided comprises a region in the arrangement direction at which at least one of the inlet of one of the plurality of supply liquid passages and the outlet of one of the plurality of return liquid passages is formed.

5. The liquid ejection head according to claim 4, wherein the supply coupling liquid passage communicates with a liquid storage chamber via a supply opening formed on one side of the inlets of the plurality of supply liquid passages in the arrangement direction, wherein the return coupling liquid passage communicates with the storage chamber via a return opening formed on the one side or the other side of the outlets of the plurality of return liquid passages in the arrangement direction, and wherein the region in the arrangement direction at which the damper film is provided comprises at least a portion of a region in the arrangement direction at which at least one of the supply opening and the return opening is formed.

6. The liquid ejection head according to claim 1, wherein a region in the arrangement direction at which the damper film is provided comprises a region in the arrangement direction at which the inlet of one of the plurality of supply liquid passages is formed.

7. The liquid ejection head according to claim 1, wherein a plurality of damper films each as the damper film are spaced apart from each other in the arrangement direction.

8. The liquid ejection head according to claim 7, wherein any one of the plurality of damper films is provided at each of (i) a portion of the supply coupling liquid passage which communicates with the inlet of each of the plurality of supply liquid passages and (ii) a portion of the return coupling liquid passage which communicates with the outlet of each of the plurality of return liquid passages.

9. The liquid ejection head according to claim 1, wherein one damper film as the damper film which is in contact with the supply coupling liquid passage and the return coupling liquid passage is provided between the supply coupling liquid passage and the return coupling liquid passage in the orthogonal direction.

10. The liquid ejection head according to claim 1, wherein two damper films as the damper film which are spaced apart from each other in the orthogonal direction are provided between the supply coupling liquid passage and the return coupling liquid passage in the orthogonal direction.

11. The liquid ejection head according to claim 1, wherein the supply coupling liquid passage communicates with a liquid storage chamber via a supply opening formed on one side of the inlets of the plurality of supply liquid passages in the arrangement direction, and wherein the return coupling liquid passage communicates with the storage chamber via a return opening formed on the one side of the outlets of the plurality of return liquid passages in the arrangement direction.

12. The liquid ejection head according to claim 1, further comprising:

a second supply coupling liquid passage coupling the plurality of supply liquid passages to each other and communicating with a second inlet of each of the plurality of supply liquid passages, the second supply coupling liquid passage being different from a first supply coupling liquid passage as the supply coupling liquid passage, the second inlet being different from a first inlet as the inlet of each of the plurality of supply liquid passages; and a second return coupling liquid passage coupling the plurality of return liquid passages to each other and communicating with a second outlet of each of the plurality of return liquid passages, the second return coupling liquid passage being different from a first return coupling liquid passage as the return coupling liquid passage, the second outlet being different from a first outlet as the outlet of each of the plurality of return liquid passages, wherein in each of the plurality of supply liquid passages, the inlet of the corresponding one of the plurality of individual passages is formed between the first inlet and the second inlet, and wherein in each of the plurality of return liquid passages, the outlet of the corresponding one of the plurality of individual passages is formed between the first outlet and the second outlet.

13. The liquid ejection head according to claim 12, wherein the second supply coupling liquid passage and the second return coupling liquid passage extend in the arrangement direction, are located on the other side of the plurality of supply liquid passages and the plurality of return liquid passages in the extending direction, and comprising a second overlapping portion at which the second supply coupling liquid passage and the second return coupling liquid passage at least partly overlap each other when viewed in the orthogonal direction, and the second overlapping portion is different from a first overlapping portion as the overlapping portion, and wherein a damper film is provided between the second supply coupling liquid passage and the second return coupling liquid passage in the orthogonal direction at the second overlapping portion.

14. The liquid ejection head according to claim 1, wherein a length of the return coupling liquid passage in the orthogonal direction is less than that of the supply coupling liquid passage in the orthogonal direction.

* * * * *